United States Patent [19]

Peterson

[11] 4,045,111

[45] Aug. 30, 1977

[54] ELECTRICAL TERMINATION DEVICE AND METHOD

[75] Inventor: Carl W. Peterson, Westminster, Calif.

[73] Assignee: International Telephone and Telegraph Corporation, New York, N.Y.

[21] Appl. No.: 663,908

[22] Filed: Mar. 4, 1976

[51] Int. Cl.[2] ..... H01R 9/08

[52] U.S. Cl. ..... 339/97 R; 339/252 R

[58] Field of Search ..... 339/95, 97–99, 339/252

[56] References Cited

U.S. PATENT DOCUMENTS

| | | | |
|---|---|---|---|
| 3,147,058 | 9/1964 | Zdanis | 339/97 R |
| 3,403,372 | 9/1968 | Stinson, Jr. | 339/97 R |
| 3,964,816 | 6/1976 | Marozny | 339/99 R |

FOREIGN PATENT DOCUMENTS

| | | | |
|---|---|---|---|
| 542,852 | 12/1952 | Belgium | 339/97 R |

*Primary Examiner*—Joseph H. McGlynn
*Attorney, Agent, or Firm*—Thomas L. Peterson

[57] ABSTRACT

An electrical termination device comprising an electrically conductive tubular member having a pair of longitudinally extending slots in the opposite sides thereof defining conductor insulation and core penetrating edges. The slots terminate in enlarged, generally aligned, openings. The conductor is inserted laterally into the tubular member through the enlarged openings and is pulled at an angle into the slots to cause the insulation and core of the conductor to be penetrated by the opposed edges of the slots, respectively. No tool is required to connect the termination device to the conductor.

21 Claims, 21 Drawing Figures

ELECTRICAL TERMINATION DEVICE AND METHOD

CROSS REFERENCE TO RELATED APPLICATION

The invention disclosed in this application constitutes a modification of the invention disclosed in my copending application, entitled "Electrical Connector and Contacts Therefor," Ser. No. 527,600, filed Nov. 27, 1974, now U.S. Pat. No. 3,955,873, assigned to the assignee of the present invention.

BACKGROUND OF THE INVENTION

This invention relates generally to an electrical termination device and, more particularly, to an insulation penetrating, solderless type termination device.

Crimping techniques are commonly utilized for securing contacts to insulated wires. In accordance with such techniques, the wire end must be stripped of its insulation covering and the contact barrel is then crimped onto the bare wire. Subsequently, the contact is inserted into a contact receiving cavity in a housing of an electrical connector. The contacts are usually individually removable from the contact receiving cavities so that a damaged contact may be replaced. The crimping of individual contacts is obviously time comsuming. Moreover, crimping generally cannot be performed on contacts which are already mounted in a connector housing since it is impractical to design crimping tools which are capable of crimping the end of the contact to a wire due to the common use of a large number of contacts with closely spaced centers. Thus, what is desired is a termination system which requires no crimping of contacts.

Termination techniques are known in the art in which conductors are connected to contacts without crimping. Such devices are normally referred to as "solderless" contacts. The following United States patents disclose various forms of solderless contacts: U.S. Pat. Nos. 3,012,219; 3,234,498; 3,617,983; 3,683,319; 3,718,888; 3,758,935; 3,760,335; and 3,761,886. Each of these patents discloses a plate-like section having a slot adapted to receive an insulated wire which is pushed into the slot at a right angle with respect to the plate.

U.S. Pat. No. 3,403,703 to Stinson, Jr., discloses a solderless contact of tubular configuration formed with opposed longitudinally extending slots which define conductor core and insulation severing jaws, respectively. In this contact, the insulated wire is pushed into the slots from the end of the contact at a right angle with respect to the axis of the tubular member. A special tool is disclosed to facilitate the insertion of the wire into the contact. The aforementioned copending application discloses a similar tubular contact in which the wire is inserted into the slots in the contact at an acute angle using the rear portion of the connector housing as a tool to accomplish the termination of the wire to the contact.

The present invention constitutes a modification of the termination arrangement disclosed in my copending application in that it does not require any form of a tool for terminating the wire to the termination device. The termination device requires little space, thereby permitting a multiplicity of such devices to be closely spaced on an insulator. The termination device is also characterized by simplicity and extremely low cost, and effects good mechanical and electrical integrity between the termination device and the wire terminated thereto without the requirement of stripping, crimping, or soldering.

SUMMARY OF THE INVENTION

According to the principal aspect of the present invention, there is provided a solderless type termination device comprising an electrically conducting tubular member having longitudinally extending slots therein on generally opposite sides of the tubular member defining conductor insulation and core penetrating opposed edges, respectively. The novel feature of the invention is the provision of enlarged openings in the tubular member at one end of the slots. The openings are aligned with each other so that a conductor may be inserted laterally into the termination device through the enlarged openings. The conductor is pulled at an angle into the slots to cause the insulation penetrating edges on the termination device to penetrate the insulation of the conductor and the core penetrating edges to penetrate the core of the conductor, thereby providing a gas-tight electrical interface between the termination device and the core of the conductor and strain relief for the conductor. Thus, no tool of any sort is required to terminate a wire to the termination device of the present invention. The termination device of the present invention is simple in construction, inexpensive to manufacture, and results in savings in the handling, labor, and maintenance of termination systems.

Figure 6:
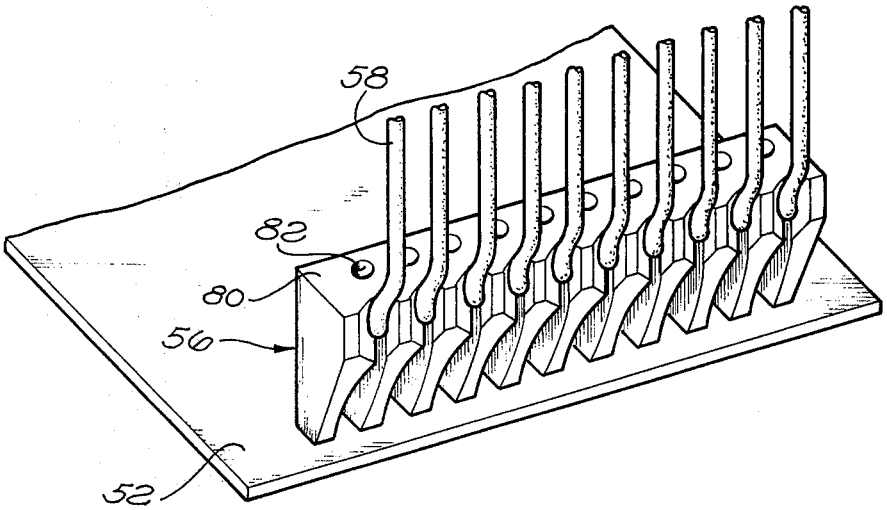
FIG. 6 is a perspective view of a printed circuit board assembly in which a row of termination devices as illustrated in FIGS. 1 to 4 are mounted on a printed circuit board with an insulator housing mounted over the devices.
Figure 11:
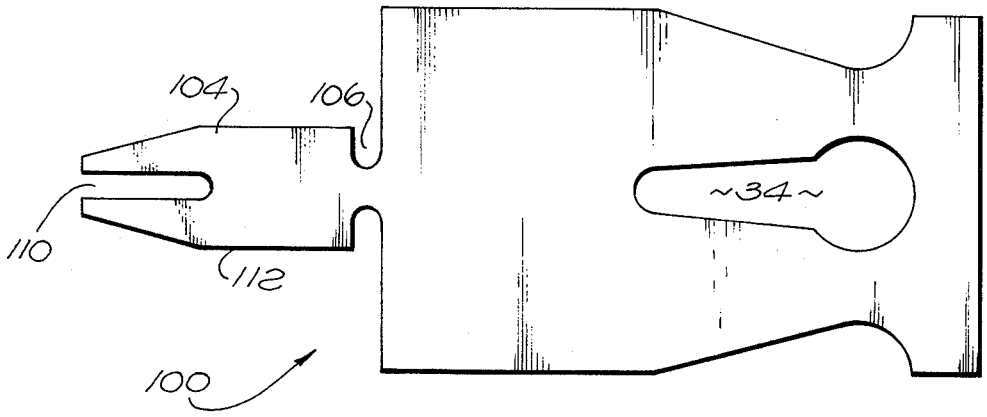
Figure 9:
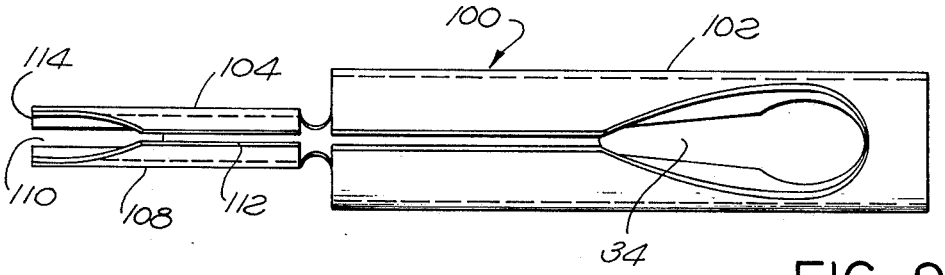
Figure 10:
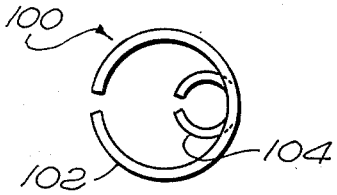
Figure 13:
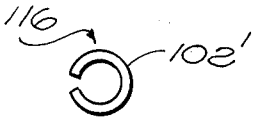
Figure 12:
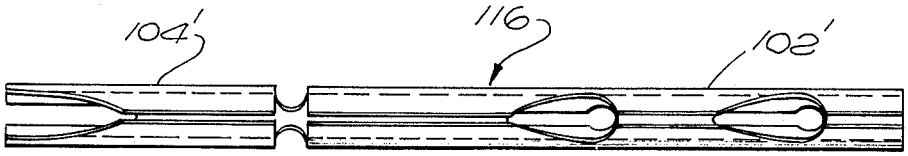
Figure 14:
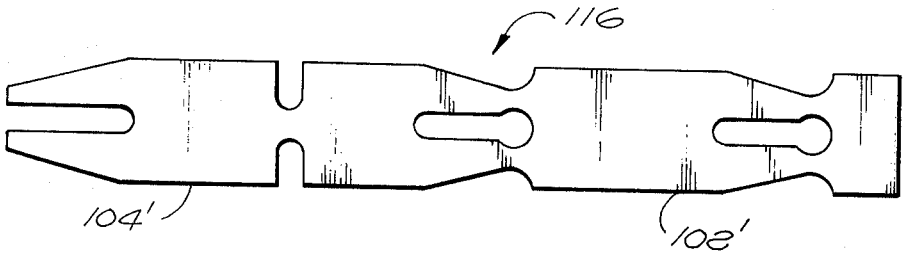
Figure 16:
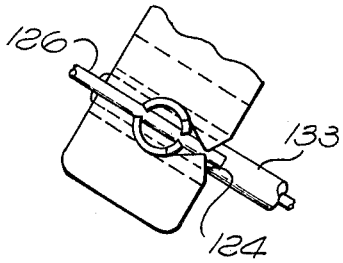
Figure 15:
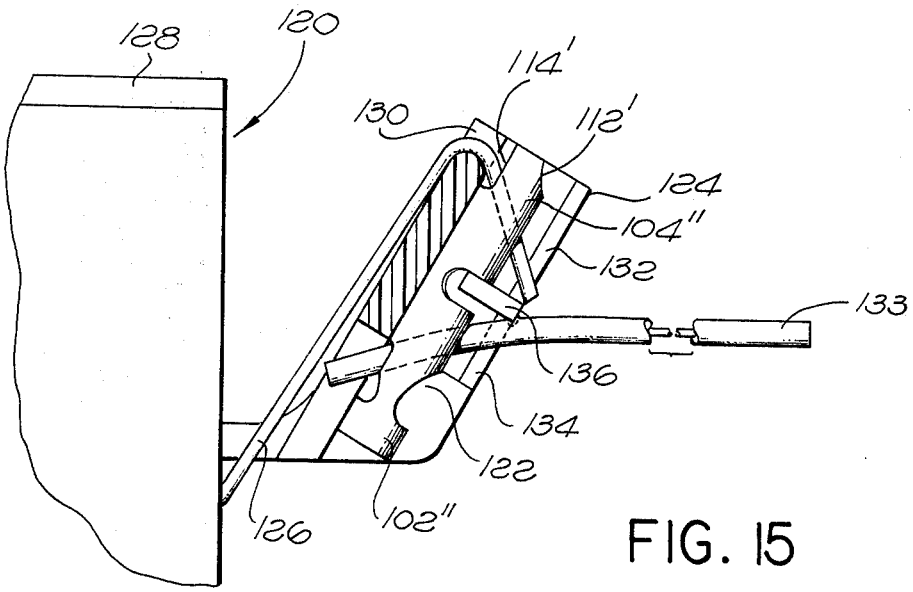

FIGS. *7a* – *7c* illustrate the various steps utilized in assembling the connector assembly illustrated in FIG. 6;

FIGS. *8a* – *8d* illustrate the various steps utilized in terminating a conductor to one of the termination devices utilized in the assembly illustrated in FIG. 6;

FIG. 9 is a top plan view of a double ended termination device in accordance with an alternative embodiment of the present invention;

FIG. 10 is an end view of the device illustrated in FIG. 9;

FIG. 11 is a developed sheet metal blank from which the device in FIGS. 9 and 10 is produced;

FIG. 12 is a top plan view of a further form of the termination device of the present invention adapted to terminate three wires;

FIG. 13 is an end view of the device illustrated in FIG. 12;

FIG. 14 is a developed sheet metal blank form which the device in FIGS. 12 and 13 is produced;

FIG. 15 is a fragmentary side view, in partial vertical section, of a transformer employing a double ended termination device in accordance with another embodiment of the present invention; and FIG. 16 is a fragmentary top plan view of the transformer illustrated in FIG. 15.

DESCRIPTION OF THE PREFERRED EMBODIMENTS

Referring now to FIGS. 1 to 5 of the drawings in detail, there is illustrated one form of the termination device of the present invention, generally designated 10. The device comprises an electrically conductive tubular member 12. A slot 14 extends longitudinally through one side of the wall of the tubular member from one end 16 to the opposite end 18 thereof. The slot in the tubular member defines a pair of resilient, arcuate, side walls 20 and 22 and longitudinally extending spaced edges 24 and 26, respectively. The resilient side walls provide a spring action which causes the edges 24 and 26 to make electrical connection to a conductor, not shown, comprising a metallic core covered with insulation. The edges 24 and 26 are uniformly spaced apart adjacent to the end 16 of the device. The distance between the edges 24 and 26 is less than the diameter of the core of the conductor so that the core will be penetrated by the edges 24 and 26 when the conductor is pushed into the slot 14. The edges of the slot 14 diverge outwardly at 28 and 30 in the direction toward the end 18 of the tubular member 12. The outwardly divering edges 28 and 30 define an enlarged opening 32.

Figure 1:
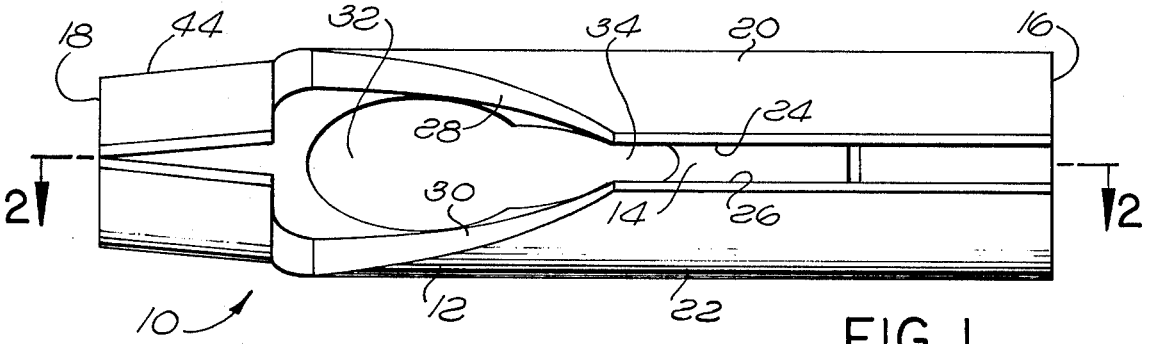
FIG. 1 is a top plan view of the preferred form of the termination device of the present invention, shown greatly enlarged.
Figure 2:
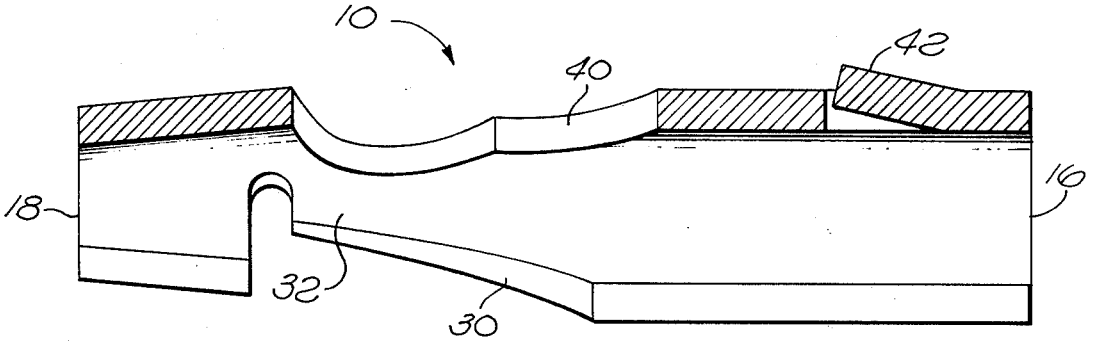
FIG. 2 is a longitudinal sectional view of the device taken along line 2—2 of FIG 1.
Figure 4:
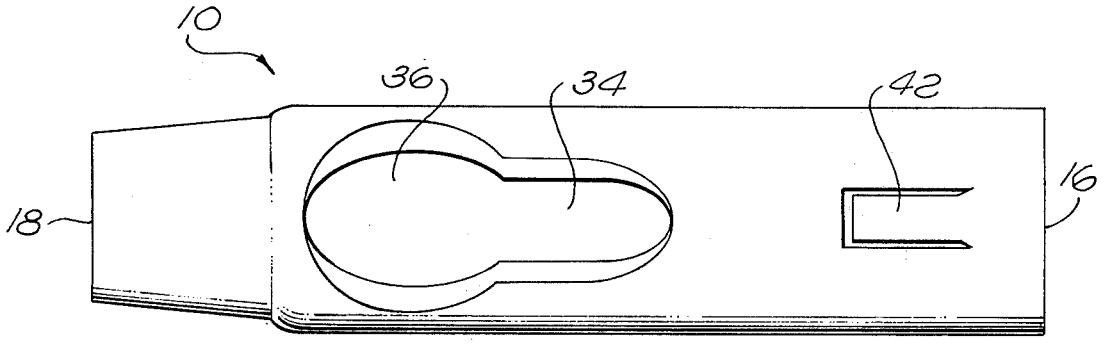
FIG. 4 is a bottom plan view of the termination device illustrated in FIG. 1.
Figure 3:
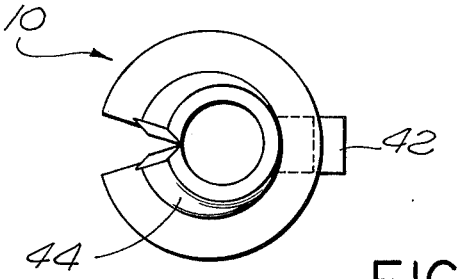
FIG. 3 is an end view of the termination device illustrated in FIG. 1.
Figure 5:
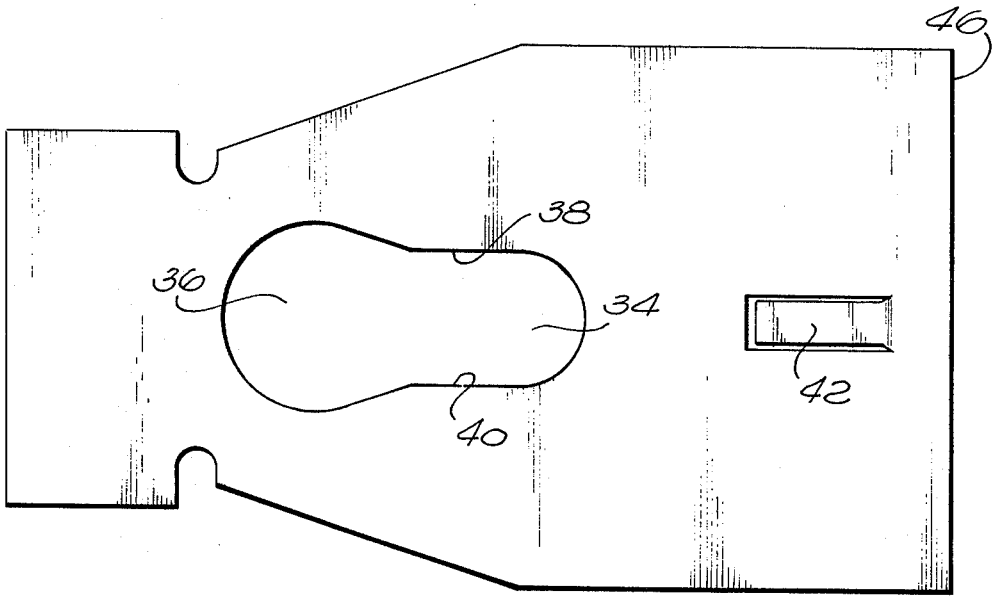
FIG. 5 is a developed sheet metal blank from which the termination device of FIG. 1 is produced.

The edges 24 and 26 of the termination device extend radially while the outwardly diverging edges 28 and 30 have a tapered, arcuate configuration, as best seen in FIG. 1. The tapered, arcuate edges 28 and 30 commence from the radially extending edges 24 and 26 and taper into a generally flat plane. Thus, the edges 24, 26, 28, and 30 provide cutting edges for a conductor. The enlarged opening 32 is dimensioned to receive the conductor thereinto.

A second longitudinally extending slot 34 is formed in the tubular member 12 on the side thereof opposite to the slot 14. The slot 34 extends a short distance beyond the diverging edges 28 and 30 in the direction of the end 16 of the tubular member. The other end of the slot 34 terminates in an enlarged opening 36 which is generally aligned with opening 32 in the tubular member. The opening 36 is also dimensioned to receive the conductor therein. The edges 38 and 40 of the slot 34 are uniformly spaced apart a distance greater than the edges 24 and 26 defined by the slot 14. The edges 38 and 40 extend radially to provide cutting edges. The distance between the edges 38 and 40 is less than the diameter of the conductor terminated to the device 10, and greater than the diameter of the core of the conductor. Thus, when the conductor is pushed into the slot 34, only the insulation on the conductor will be penetrated by the cutting edges 38 and 40, thereby providing strain relief for the conductor. A generally longitudinally extending outwardly bent retention finger 42 is stamped out of the wall of the tubular member 12 on the side thereof where the slot 34 is formed. The purpose of this retention finger will be described later.

The end portion 44 of the tubular member 12 between the openings 32 and 36 and the end 18 is tapered toward the end, as best seen in FIG. 1, for facilitating insertion of the device into a hole in a mounting board, which also will be described later. Preferably, the termination device is made from conductive, stiffly resilient material comprising a suitable sheet metal which is stamped to provide a blank 46, illustrated in FIG. 5, and then shaped into the required tubular configuration. Although the device 12 has a basically tubular configuration, it may have a different configuration, such as eliptical if desired.

Reference is now made to FIG. 6 of the drawings which illustrates a printed circuit board assembly on which there is mounted a plurality of the termination devices 10 as illustrated in FIGS. 1 to 4. The assembly, generally designated 50, comprises a printed circuit board 52 having a row of plated-through holes 54 therein, one of such holes being seen in FIG. 7*a*. The end through holes 54 therein, one of such holes being seen in FIG. 7*a*. The end portions 44 of the termination devices 10 are mounted in the plated-through holes 54. An insulator housing 56 of elongated strip configuration is mounted over the termination devices 10. Conductors 58 are shown connected to the termination devices.

Figure 7A:
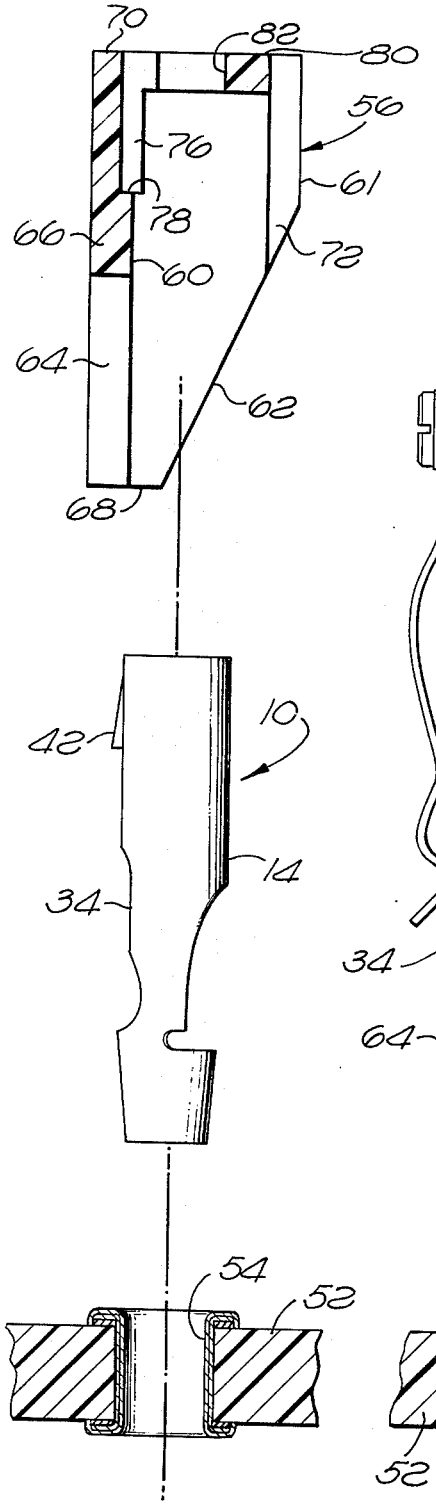

Referring to FIG. 7*a* of the drawings, which illustrates the housing 56 in transverse vertical section, it is noted that the housing contains a plurality of vertically extending cylindrical bores 60 each dimensioned to receive a termination device 10 therein. The lower edge of the housing 56 at the front wall 61 thereof is bevelled as indicated at 62. A vertically extending slot 64 is formed in the rear wall 66 of the housing in communication with each of the bores 60. The slot 64 extends upwardly from the lower end 68 of the housing, but terminates short of the upper end 70 of the housing. A vertically extending slot 72 is formed in the front wall 61 of the housing in communication with each of the bores 60. The slots 72 and 64 are in alignment with each other. The width of the slot 64 is greater than the diameter of the conductor to be terminated to the termination device 10. The width of the slot 72 is less than the diameter of the conductor so that when the conductor is pulled into the slot 72 strain relief for the conductor will be provided.

A vertically extending recess 76 is formed on the inside of the rear wall 66 of the housing. The recess opens at the top 70 of the housing and terminates at its lower end in an upwardly facing shoulder 78. The slot 76 is dimensioned to slidably receive the resilient retention finger 42 on the termination device 10.

A wall 80 extends across the upper end 70 of the housing. An aperture 82 is formed in the wall 80 in alignment with each of the bores 60. The diameter of the aperture 82 is less than the diameter of the tubular termination device 10.

Figure 7B:
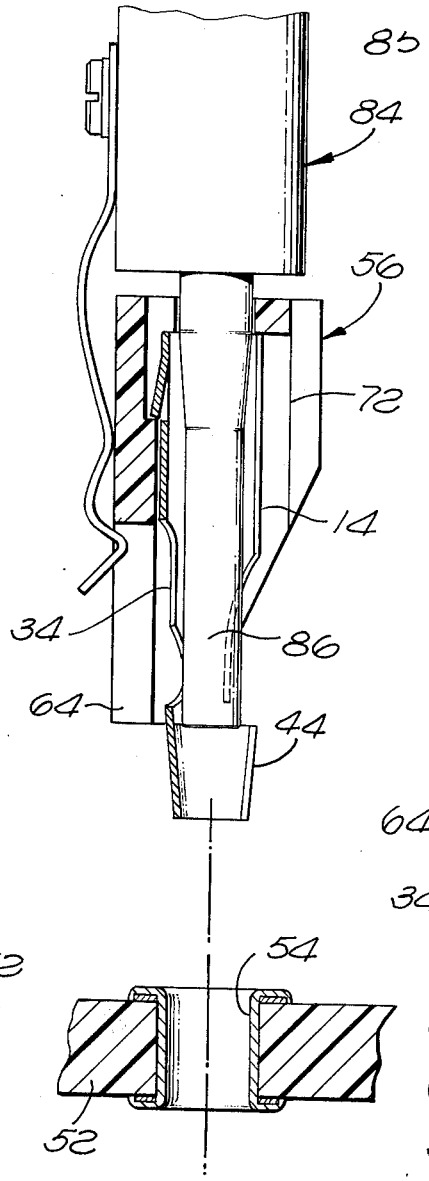
Figure 7C:
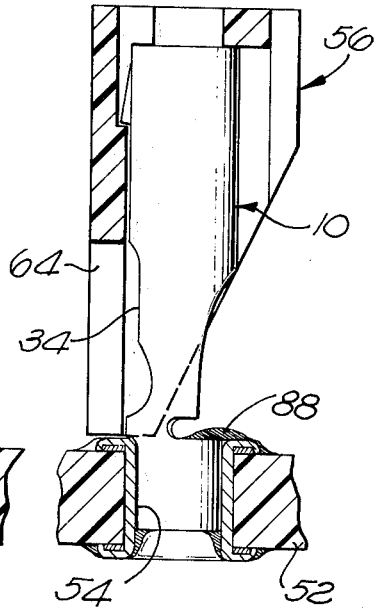

Reference is now made to FIGS. 7*a* – 7*c* which illustrate how the printed circuit board assembly 50 in FIG. 6 is assembled. Initially, the termination devices 10 are pushed upwardly into the bores 60 in the housing 56 with the retention fingers 42 aligned with the recesses 7*b*. With the retention fingers alinged with the recesses, the slots 14 in the termination device are aligned with the slots 72 in the housing and the slots 34 are aligned with the slots 64 in the housing. Upward movement of the termination devices in the bores causes the retention fingers 42 to deflect inwardly when they pass the tops of the slots 64 and engage the inside of the rear wall 66. Once the retention fingers pass the shoulders 78, the fingers will expand outwardly into the recesses and the ends of the fingers will engage the shoulders thereby locking the termination devices in the housing.

With a plurality of termination devices 10 loaded in the housing 56, the housing is positioned on a tool 84 which has downwardly depending cylindrical rods 86, only one being seen in FIGS. 7*b*, that extend through the apertures 82 in the upper wall of the housing and engage at their lower ends with the lower end portions 44 of the termination devices. The tool is positioned in alignment with the row of plated-through holes 54. The tool is pushed downwardly by the use of a press or other suitable device causing the tapered lower end portions of the termination devices to be frictionally retained in the plated-through holes. Thereafter, the tool is removed, then the lower tapered portions of the termination devices 10 are soldered in the plated-through holes, as indicated at 88. When the termination devices are fully mounted in the plated-through holes, the enlarged openings 32 and 36 therein are positioned immediately above the printed circuit board 52, and the slots 14 and 34 in the devices extend upwardly from the holes. The upper ends of the slots 34 terminate at the upper ends of the slots 64 in the housing 56.

Figure 8A:
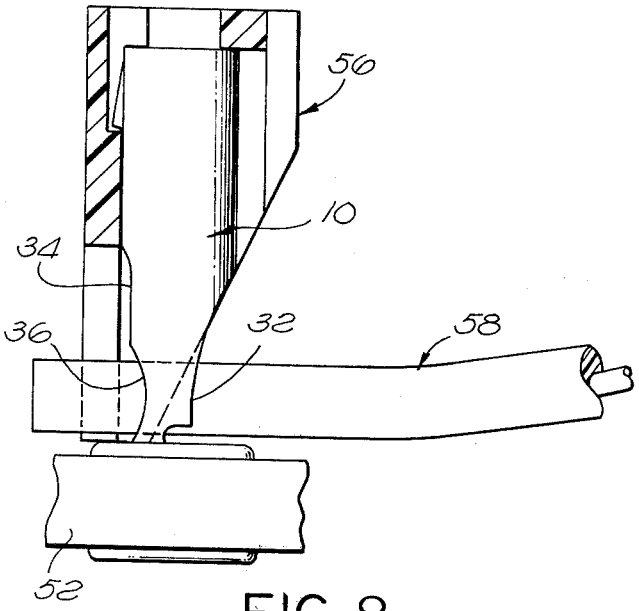
Figure 8B:
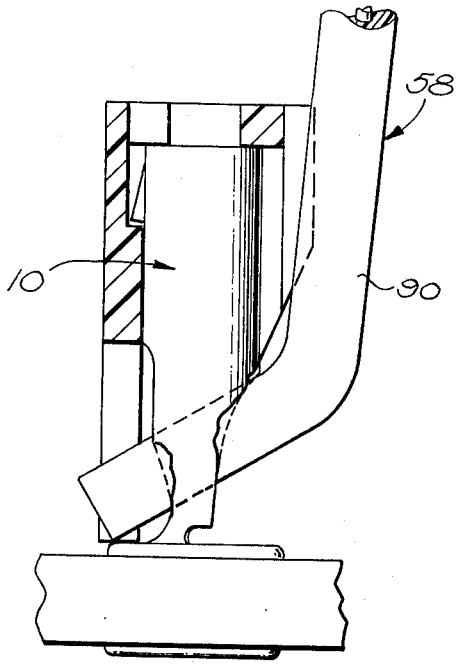
Figure 8C:
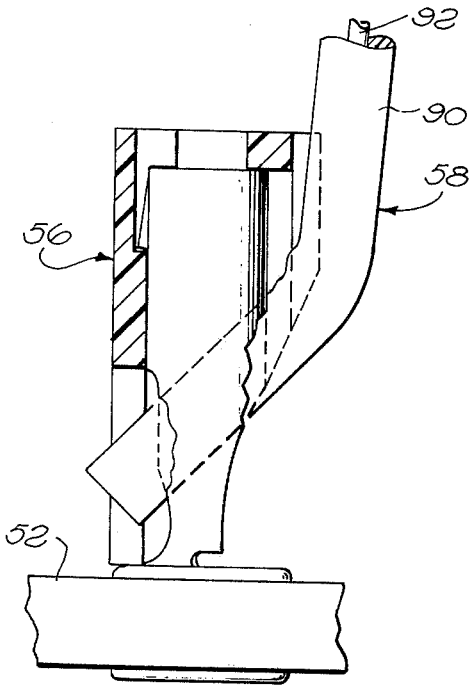
Figure 8D:
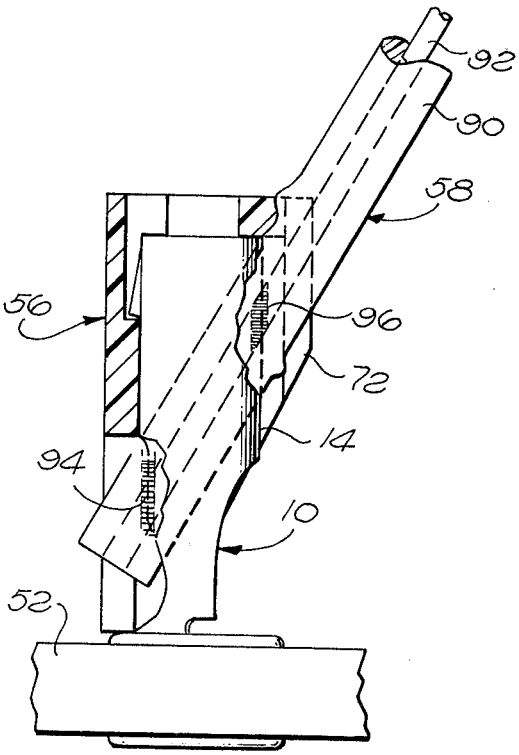

Reference is now made to FIGS. 8*a* – 8*d* which illustrate how one of the conductors 58 is connected to a termination device 10 mounted in the board 52. The conductor 58 is inserted into the termination device laterally through the enlarged openings 32 and 36 from the front of the housing 56, as seen in FIG. 8*a.* The conductor is then pulled upwardly at an angle of about 20° with respect to the longitudinal axis of the termination device causing the insulation 90 of the conductor to engage the termination device in two places. The conductor then begins to track in the termination device, that is, it is guided for movement in the slots 14, 34, as in the insulation is stripped from the conductor by the cutting edges 28, 30, 38, and 40, as seen in FIG. 8*b.* As seen in FIG. 8*c,* during further upward pulling movement of the conductor 58, the conductor engages the termination device at an angle of about 45° to begin the electrical connection. FIG. 8*d* shows when full conductor engagement with the termination device is complete when the conductor is at an angle of about 30° with respect to the device 10. In this position of the conductor, the lower end of the conductor is fully pulled into the slot 34 where the edges thereof 38 and 40 penetrate the insulation 90 of the conductor, but not the core 92 thereof, as shown by the shaded region 94. An upper region of the conductor is pulled into the slot 14 between the cutting edges 24 and 26, which have severed the insulation 90 and penetrated the core 92 of the conductor, as shown by the shaded region 96 in FIG. 8*d.* Also, the region of the conductor above the electrical connection region 96 is tightly fitted in the slot 72 on the front of the housing 56 providing front strain relief for the conductor. Thus, strain relief is provided on opposite sides of the electrical connection made between the conductor 58 and the termination device 10.

It will be appreciated from the foregoing that by the present invention an electrical conductor may be effectively connected to a termination device by simply inserting the conductor laterally into the device and pulling upwardly on the conductor. There is no requirement for a tool to effect the electrical connection. Thus, the present invention provides substantial cost savings in tooling, handling, labor, and maintenance. The invention is therefore particularly useful for commercial and industrial applications requiring low installation and assembly costs.

Further, the termination device is simple in configuration, and may be easily manufactured by use of standard stamping and forming techniques, thus resulting in an extremely low cost connection element. The termination device provides reliable solderless connections to either solid or stranded, insulated or non-insulated wires. The resilent, arcuate side walls 20 and 22 of the termination device produce a two-way spring action that insures maximum contact pressure on the conductor. The force levels achieved in the termination device during the wire terminating operation strips the insulation, and removes oxides and contaminants from both the conductor and the termination device, thus producing a gas-tight electrical interface having maximum surface area contact. Thus, the termination arrangement of the present invention offers extremely low end cost without sacrificing mechanical and electrical integrity in the connection.

It will, of course, be appreciated that the termination device 10 may be mounted either alone or in any suitable pattern in or on an insulator. It is only necessary that the enlarged openings 32, 36, and the slots associated therewith be exposed so that a conductor may be inserted through the openings and pulled into the slots to effect the termination. Either end of the termination device may be fixedly mounted in an insulator. Further, it may not always be necessary to provide an insulator housing substantially enclosing the termination device, as in the assembly illustrated in FIG. 6. Various modifications in the termination device itself may also be adopted. For example, in the embodiments illustrated in FIGS. 9 to 11 and FIGS. 12 to 14, the termination devices disclosed therein are double ended. Referring specifically to FIGS. 9 and 10, there is shown a double ended termination device, generally designated 100. The right hand end of the device as viewed in FIG. 9 is a termination component 102 which is essentially identical to the termination device 10. The only difference between the component 102 and the device 10 is that the edges of the slot 34 are slightly tapered so that the edges will penetrate the insulation on a conductor further than when using the device 10. The device 100 embodies a second termination component 104 which is integrally connected to the component 102 by a connecting web 106. Component 104 may be identical to that disclosed in my aforementioned copending application and has been previously described briefly herein. The component 104 comprises a longitudinally split tubular member 108 having opposed insulation receiving and conductor penetrating slots 110 and 112, respectively, which open at the end 114 of the tubular member. A conductor is terminated to the component 104 by pushing the conductor transversely into the slots from the end 114. It is noted from FIG. 10 that the termination component 102 has a greater diameter than the component 104. The termination components 102 and 104 are generally aligned with each other, but the component 104 is offset slightly from the longitudinal axis of the component 102. FIG. 11 illustrates the flat sheet metal blank from which the termination device 100 is produced.

The double ended termination device 116 illustrated in FIGS. 12 and 13 is similar to the device 110 and like reference numerals primed are utilized to designate like or corresponding parts. In this embodiment, the diameters of the tubular termination components 102' and 104' are identical, and the components are concentric with respect to each other. The component 102' contains two sets of a conductor receiving openings and termination slots rather than just one set as in the device 100. FIG. 14 illustrates the blank from which the device 116 is produced.

FIG. 15 illustrates a portion of a transformer, generally designated 120, in which a double ended termination device 122 is mounted in an insulator mounting section 124. The termination device 122 is similar to the device 100 illustrated in FIGS. 9 and 10 and like reference numerals with double primes are used to designate like or corresponding parts. In this embodiment, as in the device 116, the diameters of the termination components 102″ and 104″ are equal and the components are concentric with respect to each other. The component 104″ differs from the component 104 in that the slots 112″ and 114″ are both dimensioned to penetrate an uninsulated woven wire 126 which extends from the transformer housing 128. Forward and rear slots 130 and 132 are formed on the opposite sides of the upper region of the insulator section 124. These slots are dimensioned to provide strain relief for the wire 126, which is pushed vertically down through the slots 114″, 112″ to terminate the wire to the device 122. An insulated conductor 133 is shown terminated to the termination component's lower end 102″ of the device 122 in the manner described in detail previously herein. A slot 134 is also formed in the front of the insulator section 124 in alignment with the slot 132 and dimensioned to provide strain relief for the conductor 133. An insulator locking element 136 serves to fixedly retain the termination device 122 within the insulator section 124. If the wire 126 were provided with an insulation coating, it will be appreciated that the slot 114″ may be formed wider as in the component 104 to provide strain relief between the termination device 122 and the insulated wire. Other mounting arrangements for the termination devices of the present invention disclosed herein will be apparent to those skilled in the art.

What is claimed is:

1. A termination device for making electrical connection to an electrical conductor having a metallic core with insulation comprising:

an electrically conductive tubular member;

a first slot extending longitudinally through said tubular member to the opposite ends thereof defining a pair of resilient arcuate side walls;

the edges of said side walls defined by said slot being uniformly spaced from each other adjacent to one end of said tubular member;

the distance between said uniformly spaced edges being less than the cross-section of the core of the conductor;

said edges diverging outwardly in the direction of the other end of said tubular member to an enlarged opening;

a second enlarged opening in said tubular member on the side thereof opposite to said first-mentioned opening and generally aligned therewith, said first and second openings being sufficiently large to receive the conductor thereinto; and a second slot in said tubular member on said opposite side thereof extending from said second opening toward said one end, the edges of said tubular member defined by said second slot being spaced from each other, the distance between said second-mentioned edges being less than the cross-section of the conductor but greater than the cross-section of the core thereof, whereby the conductor may be inserted laterally into said tubular member through said openings from the side of said tubular member embodying said first slot and may be pulled at an angle toward said one end of said tubular member causing said first-mentioned edges to sever the insulation and penetrate the core at one region of the conductor and causing said second-mentioned edges to penetrate the insulation at a second region of the conductor providing strain relief for the conductor

2. A termination device as set forth in claim 1 wherein:

said second slot is generally aligned with the outwardly diverging edge region of said first slot.

3. A termination device as set forth in claim 1 wherein:

said second slot is spaced from said one end of said tubular member.

4. A termination device as set forth in claim 1 wherein:

said openings are spaced from said other end of said tubular member.

5. A termination device as set forth in claim 4 wherein:

the end portion of said tubular member between said openings and said other end tapers toward said other end to facilitate insertion of said end portion into a mounting hole.

6. A termination device as set forth in claim 1 including:

an insulator housing mounted on said tubular member, said housing having an aperture therein aligned with said first slot in said tubular member.

7. A termination device as set forth in claim 6 wherein:

said aperture has a relatively open region adjacent to said first opening dimensioned to freely receive the conductor thereinto and a relatively restricted region adjacent to said one end of said tubular member dimensioned to frictionally receive the conductor thereby providing strain relief for the conductor at a third region of the conductor.

8. A termination device as set forth in claim 6 including:

means releasably retaining said housing on said tubular member.

9. A termination device as set forth in claim 6 wherein:

the end portion of said tubular member adjacent to said other end extends outside of said housing; and said housing embodies an end wall extending over said other end of said tubular member.

10. A termination device as set forth in claim 1 including:

a second electrically conductive tubular member integrally connected at one end thereof with said first-mentioned tubular member and generally axially aligned therewith, said second tubular member being adapted to terminate a second electrical conductor having a metallic core covered with insulation;

a first slot extending longitudinally through said second tubular member to the opposite ends thereof defining a second pair of resilient arcuate side walls;

the edges of said second side walls defined by said first slot in said second tubular member being uniformly spaced from each other adjacent to said one end of said second tubular member, said edges diverging outwardly to the other end of said second tubular member providing an entrance for said second conductor;

the distance between said uniformly spaced edges of said second side walls being less than the cross-section of the core of the second conductor; and a second slot in said second tubular member on the side thereof opposite to said first slot therein and extending from said other end toward, but short of, said one end of said second tubular member; the edges of said second tubular member defined by said second slot therein being spaced from each other, the distance between said second-mentioned edges in said second tubular member being less than the cross-section of the second conductor but greater than the cross-section of the core thereof.

11. A termination device as set forth in claim 10 wherein:

said first slots in said first and second tubular members face in the same direction.

12. A termination device as set forth in claim 1 including:

a second electrically conductive tubular member integrally connected at one end thereof with said first-mentioned tubular member and generally axially aligned therewith, said second tubular member being adapted to terminate a second electrical conductor;

a first slot extending longitudinally through said second tubular member to the opposite ends thereof defining a second pair of resilient arcuate side walls;

the edges of said second side walls defined by said first slot in said second tubular member being uniformly spaced from each other adjacent to said one end of said second tubular member, said edges diverging outwardly to the other end of said second tubular member providing an entrance for said second conductor;

the distance between said uniformly spaced edges of said second side walls being less than the cross-section of the second conductor; and a second slot in said second tubular member on the side thereof opposite to said first slot therein and extending from said other end toward, but short of, said one end of said second tubular member, the edges of said second tubular member defined by said second slot therein being spaced from each other, the distance between said second-mentioned edges in said second tubular member being less than the cross-section of the second conductor.

13. A termination device as set forth in claim 12 wherein:

said first slots in said first and second tubular members face in the same direction.

14. A termination device as set forth in claim 13 including:

an insulator housing partially enclosing said tubular members;

said housing having a conductor insulation strain relief means thereon adjacent to said first slots in said tubular members.

15. A termination device as set forth in claim 14 including:

second conductor strain relief means on said housing adjacent to said second tubular member second slot.

16. A termination device for making electrical connection to an electrical conductor having a metallic core covered with insulation comprising:

an electrically conductive tubular member having longitudinally extending slots therein on generally opposite sides of said tubular member defining relatively closely spaced-apart core penetrating opposed edges and relatively further spaced-apart insulation penetrating edges, respectively;

said slots terminating in enlarged, generally alinged openings whereby the conductor may be inserted laterally into said tubular member through said enlarged openings and may be pulled at an angle into said slots to cause said insulation penetrating edges to penetrate the insulation of the conductor and said core penetrating edges to penetrate the core of the conductor; and said tubular member having a longitudinal seam therein extending to the opposite ends thereof and passing through one of said slots.

17. An electrical connector assembly comprising:

a planar mounting board having a hole therein;

a vertically extending tubular termination device having a lower end portion thereof mounted in said hole;

generally opposed enlarged openings in said tubular termination device above said board;

generally opposed slots in said device extending upwardly from said openings, said slots defining conductor insulation and core opposed, penetrating edges, respectively;

said tubular termination device having a longitudinal seam therein extending to the opposite ends thereof and passing through one of said slots; and said enlarged openings being dimensioned to receive therein a conductor extending laterally through said device whereby upward pulling of the conductor in the device at an angle will cause said insulation penetrating edges to penetrate the insulation of the conductor and said core penetrating edges to penetrate the core of the conductor.

18. An electrical connector assembly as set forth in claim 17 wherein:

said board is a printed circuit board and said hole is a plated through hole.

19. A method of connecting a termination device to an electrical conductor having a metallic core covered with insulation, comprising the steps of:

providing a termination device comprising an electrically conductive tubular member, a first slot extending longitudinally through said tubular member to the opposite ends thereof defining a pair of resilient arcuate side walls, the edges of said side walls defined by said slot being uniformly spaced from each other adjacent to one end of said tubular member, the distance between said uniformly spaced edged being less than the cross-section of said core of said conductor, said edges diverging outwardly in the direction of the other end of said tubular member to an enlarged opening, a second enlarged opening in said tubular member on the side thereof opposite to said first-mentioned opening and generally aligned therewith, said first and second openings being sufficiently large to receive said conductor thereinto, and a second slot in said tubular member on said opposite side thereof extending from said second opening toward said one end, the edges of said tubular member defined by said second slot being spaced from each other, the distance between said second-mentioned edges being less than the cross-section of said conductor but greater than the cross-section of said core;

inserting said conductor laterally into said termination device through said openings from the side of said tubular member embodying said first slot; and pulling said conductor at an angle toward said one end of said tubular member causing said first-mentioned edges to sever said insulation and penetrate said core at one region of the conductor and causing said second-mentioned edges to penetrate said insulation at a second region of said conductor providing strain relief for said conductor.

20. A method of connecting a termination device to an electrical conductor having a metallic core covered with insulation, said termination device comprising a tubular member having longitudinally extending slots therein on generally opposite sides thereof defining insulation and core penetrating edges, respectively, with said slots terminating in enlarged, generally aligned openings, comprising the steps of:

inserting said conductor laterally into said termination device through said enlarged openings; and pulling said conductor at an angle into said slots to cause said insulation penetrating edges to penetrate said insulation at one region of said conductor and said core penetrating edges to penetrate said core at a second region of said conductor.

21. A method as set forth in claim 20 including the additional steps of:

providing strain relief for said conductor at a third region thereof on the side of said second region opposite to said first region whereby strain relief is provided on opposite sides of the conductor from where the electrical connection is made to said core by said termination device.

* * * * *